US008618031B2

(12) United States Patent
Douglass et al.

(10) Patent No.: US 8,618,031 B2
(45) Date of Patent: Dec. 31, 2013

(54) METHOD FOR IMPROVING THE DEPOSIT FORMATION RESISTANCE PERFORMANCE OF TURBINE OILS CONTAINING AMINE ANTIOXIDANTS

(75) Inventors: Michael R. Douglass, Cherry Hill, NJ (US); Douglas Eugene Johnson, Cherry Hill, NJ (US); Susan Ardito, Ocean, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 175 days.

(21) Appl. No.: 13/190,895

(22) Filed: Jul. 26, 2011

(65) Prior Publication Data

US 2012/0028861 A1 Feb. 2, 2012

Related U.S. Application Data

(60) Provisional application No. 61/368,136, filed on Jul. 27, 2010.

(51) Int. Cl.
*C10M 137/04* (2006.01)

(52) U.S. Cl.
USPC ..... 508/423

(58) Field of Classification Search
USPC ..... 508/423
See application file for complete search history.

(56) References Cited

U.S. PATENT DOCUMENTS

| | | | | |
|---|---|---|---|---|
| 3,038,859 | A | 6/1962 | Eickemeyer et al. | |
| 3,121,109 | A | 2/1964 | Young | |
| 3,573,206 | A | 3/1971 | Braid | |
| 5,206,404 | A | 4/1993 | Gunkel et al. | |
| 5,560,849 | A * | 10/1996 | Shankwalkar et al. | 508/423 |
| 5,922,654 | A | 7/1999 | Yamazaki et al. | |
| 6,586,376 | B1 | 7/2003 | Nakanishi et al. | |
| 2005/0014658 | A1 | 1/2005 | Akao | |
| 2007/0179069 | A1 | 8/2007 | Burgo et al. | |
| 2007/0232504 | A1 * | 10/2007 | Goyal et al. | 508/192 |
| 2008/0058235 | A1 | 3/2008 | Takigawa et al. | |
| 2009/0253597 | A1 | 10/2009 | Wardlow et al. | |

FOREIGN PATENT DOCUMENTS

| | | |
|---|---|---|
| EP | 0612837 | 8/1994 |
| EP | 0521628 | 3/1996 |

OTHER PUBLICATIONS

Copending U.S. Appl. No. 61/368,127, filed Jul. 27, 2010.

A. Nagarajan, C. Garrido, J. E. Gatica and W. Morales, "Phosphate Reactions as Mechanisms of High-Temperature Lubrication", NASA/TM-2006-214060, May 2006.

A. Nagarajan, C. Garrido, W. Morales and J. E. Gatica, "Chemical Vapor Deposition Applications in Thin-Film Coatings for High Temperature Lubrication", AIChE Annual Meeting, Conference Proceedings, Cincinnati, Ohio, Oct. 30-Nov. 4, 2005 (564a/I-564a/11).

D. W. Johnson and S. Morrow, "Vapor-Phase Lubrication: Reaction of Phosphate Ester Vapors with Iron and Steel", Chem. Mater., 2002, 14, 3767-3775.

* cited by examiner

*Primary Examiner* — Taiwo Oladapo
(74) *Attorney, Agent, or Firm* — Robert A. Migliorini

(57) ABSTRACT

The deposit formation resistance performance of turbine oils containing amine antioxidants and antiwear additives is enhanced beyond the level of that of turbine oils containing tricresyl phosphate antiwear additive by employing as the antiwear additive a 4,4'-(Isopropylidenediphenyl)bis(diphenyl phosphate).

5 Claims, 3 Drawing Sheets

METHOD FOR IMPROVING THE DEPOSIT FORMATION RESISTANCE PERFORMANCE OF TURBINE OILS CONTAINING AMINE ANTIOXIDANTS

CROSS-REFERENCE TO RELATED APPLICATIONS

This is a non-provisional application that claims priority to U.S. Provisional Patent Application No. 61/368,136 filed on Jul. 27, 2010, herein incorporated by reference in its entirety.

FIELD

The present disclosure relates to turbine oils containing antiwear additives and antioxidants and to the improvement of the resistance to deposit formation of such turbine oils.

BACKGROUND

Turbine oils, especially aviation jet engine oils, are complex liquid lubricants designed to function under extreme conditions of temperature, pressure and load. At such conditions the turbine oil experiences volatilization of vital components as well as a loss of the ability to control or inhibit wear of critical engine parts.

To control wear, the liquid lubricant typically employs additives specifically designed as antiwear additives. Typical turbine antiwear additives are addressed and described in the prior art.

EP 0,521,628 is directed to a combination of aryl phosphates useful as antiwear additives in fuels, lubricants and functional fluids which are subjected to high temperatures under actual service conditions. The combination of aryl phosphates is comprised of: (1) at least one oil-soluble aryl phosphate of the formula:

$$(RO)_3PO$$

wherein each R is, independently, phenyl or an alkyl-substituted phenyl group; and (2) at least one oil-soluble aryl phosphate of the formula:

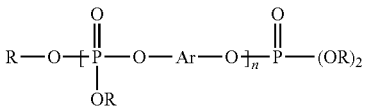

wherein each R is, independently, phenyl or an alkyl-substituted phenyl group, Ar is m-phenylene or an alkyl-substituted m-phenylene group, and n is a number from 1 to 4, said combination containing from 2 to 30% by weight of component (1). When the above formula represents a mixture of the depicted polyphosphates, n is a whole or fractional number from 1 to 4, because n in that case represents the average composition of the mixture.

The lubricant compositions which can be benefitted by the use of the composition combination are lubricating oils of lubricating viscosity, including oils composed by volume of at least 50% up to and including 100% of one or more mineral oils or one or more synthetic ester oils.

In forming the combination of aryl phosphates, use can be made of phenol and/or one or more alkyl phenols containing from 1 to 5 alkyl groups on the ring. Each alkyl group can contain up to about 18 carbon atoms provided the alkyl substituents do not sterically hinder the hydroxyl group to such an extent that the substituted phenol cannot undergo reaction to form the desired aryl phosphate.

The combination of aryl phosphates is reported to have excellent thermal stability at high temperatures, even as high as 400° C., compared to tri-n-octyl phosphate (TOP), tricresyl phosphate (TCP), tri-n-butoxy-ethyl phosphate (TBEP), and cresyl diphenyl phosphate (CDP).

When used as lubricating oil antiwear additive, the combination is employed in the range 0.005 to 20 wt % based on the total weight of the finished lubricant. The finished lubricant can contain additional additives, including ashless dispersants, zinc hydrocarbyl dithiophosphates, one or more oil-soluble sulfur-containing antiwear and/or extreme pressure agents.

U.S. Pat. No. 5,560,849 is directed to improving the antiwear properties of synthetic ester lubricants intended for use at high temperatures (150 to 350° C.) by adding to the lubricant a hydrocarbon-insoluble, synthetic ester-soluble, aryl diphosphate ester composition containing a major amount of an aryl diphosphate ester of the formula:

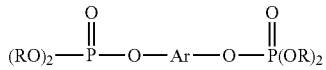

wherein Ar is an unsubstituted or alkyl ($C_1$ to $C_{12}$)-substituted arylene and R is unsubstituted or alkyl ($C_1$ to $C_{12}$)-substituted aryl.

The alkyl diphosphate ester exhibits high thermal stability, making it suitable for use as an antiwear additive in lubricants used at high temperature as a replacement for a tri-aryl phosphate ester (e.g., TCP).

The aryl diphosphate ester is employed in synthetic ester base stocks including polyol esters, diesters and phosphate esters in amounts in the range 0.1 to 10%, preferably 0.5 to 5%, based on the weight of the synthetic ester. Other additives may also be present in the synthetic ester lubricant and include lubricating agents, other antiwear additives, antioxidants, metal passivators, rust and/or corrosion inhibitors, viscosity index (VI) improvers, detergents/dispersants, defoamers/antifoamants, emulsion modifiers, seal swell agents, tackifiers, stabilizers, dyes and odor-masking agents. Antioxidants include hindered phenols, aromatic amines and zinc dialkyl/diaryl phosphate (ZDDP).

EP 0,612,837 is directed to a polyphenylene ether lubricant containing hydrocarbyl bis(dihydrocarbyl phosphate) compounds of the formula:

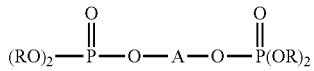

wherein R is either unsubstituted or substituted hydrocarbyl alkyl or aryl group, A is a bridging group alkylene, haloalkylene, arylene, two arylene groups joined by a bridging group (e.g., —$C(CH_3)$, —$SO_2$ or —CO) or a bridging group containing biarylene, the di-phosphate compound being used as an antiwear additive in an amount in the range of about 0.1 to 10% by weight of the lubricating composition.

U.S. Published Application 2007/0179069 is directed to high temperature, stable lubricant compositions comprising at least one polyol polyester derived from the reaction product of a neopentyl polyol with 5,7,7-trimethyl-2-(1,3,3-trimethylbutyl)-octanoic acid. This polyolester can be used in combination with other conventional polyolesters as well as in combination with other additives, including metal protecting additives such as t-butyl phenyl phosphate, mono-hexyl and di-hexyl phosphates, isopropylphenyl phosphates, tri-cresyl phosphates, tri-xylyl phosphates, di(n-octyl) phosphate, alkylated tri-phenyl phosphorothionate, tri-phenyl thiophosphate, benzotriazole, tolyltriazole and mixtures, derivatives and combinations thereof in amounts in the range of about 0.1 to 10%, preferably up to about 5%, by weight of the total composition.

Other lubricant additives include alkylated di-phenyl amines, nonylated di-phenylamine, styrenated di-phenyl amine and hindered alkyl phenols.

U.S. Pat. No. 5,206,404 is directed to a composition of alkylated phenyl phosphate esters comprising 1 to 20 wt % tri-alkyl phenyl phosphate, 10 to 50 wt % di-alkyl phenyl mono-phenyl phosphate, 15 to 60 wt % mono-alkyl phenyl di-phenyl phosphate and less than 2 wt % tri-phenyl phosphate exhibiting a combination of excellent thermal, oxidative and hydrolytic stability. Unexpectedly superior thermal and hydrolytic stability properties are obtained when the alkyl moiety is a tertiary alkyl, preferably a t-butyl moiety.

The phosphate esters are an ashless antiwear base stock of reduced volatility and find further use as a lubricant additive.

"Phosphate Reactions as Mechanisms of High Temperature Lubrication", Nagarajan, A. et al., NASA/TM-2006-213060, is directed to the study of the chemical vapor deposition of tert-butyl phenyl phosphate (TBPP) on cast iron. TBPP is reported as possessing superior oxidative, thermal and hydrolytic stability compared to other commercial phosphate ester products and can be an effective and highly stable antiwear additive in both petroleum and synthetic base stocks including polyesters, diesters and polyalphaolefins.

See also "Chemical Vapor Deposition Applications in Thin Film Coatings for High Temperature Lubrication", Nagarajan, A. et al., AIChE Annual Meeting, Conference Proceedings, Cincinnati, Ohio, Oct. 30-Nov. 4, 2005 (564a/1-564a/11); and "Vapor-Phase Lubrication: Reaction of Phosphate Ester Vapors with Iron and Steel", Johnson, D. W. et al., Chem Mater, 2002, 14, 3767-3775.

While tri-alkyl phenyl phosphates are useful as antiwear additives in polyester base turbine oil formulations containing monomeric amine antioxidants, their performance has been found to be no more beneficial than tri-cresyl phosphate when employed in turbine oil formulation containing polymeric amine antioxidants. In fact, their performance as antiwear additives is negatively impacted when employed in high performance turbine oil formulations containing polymeric amine antioxidants.

It would be an advance in turbine oil technology if a way could be found to enhance deposit formation resistance performance of turbine oil formulations containing amine antioxidants.

SUMMARY

In one form of the present disclosure disclosed herein, there is provided a method for improving the resistance to deposit formation of High Performance Category turbine oil comprising a synthetic ester base oil, one or more of a polymeric aminic antioxidant and IDP antiwear additive of the formula:

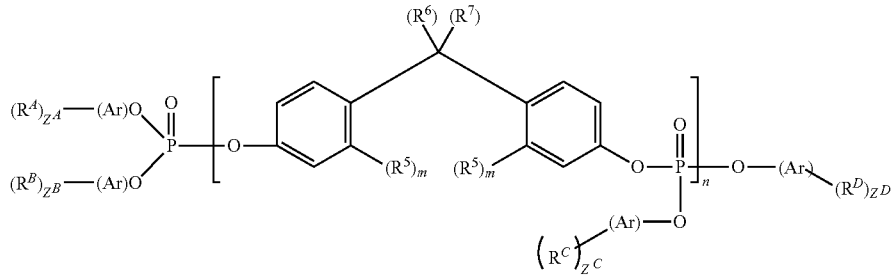

wherein $R^5$ is a $C_1$ to $C_5$ alkyl group and m is an integer ranging from zero to 4, n is an integer ranging from 1 to 7, $R^6$ is hydrogen or a $C_1$ to $C_5$ alkyl group, $R^7$ is hydrogen or a $C_1$ to $C_5$ alkyl group, each Ar is independently a phenyl or naphthyl group, $R^A$, $R^B$, $R^C$ and $R^D$ are the same or different selected from the group consisting of hydrogen, $C_1$ to $C_{18}$ alkyl groups, and when any of $R^A$ to $R^D$ are other than hydrogen the corresponding $Z^A$, $Z^B$, $Z^C$ and $Z^D$ are the same or different and range from 1 to up to the available valence of each Ar group, the IDP being present in an amount in the range of 0.01 to 10 wt % based on active ingredient and contributing from 500 to 6000 ppm phosphorus, wherein the resistance to deposit formation as measured by the Vapor Phase Coker Test at 700° F. of the turbine oil is at least 30 mg lower than the deposit formation of turbine oils containing the same ester base stock and polymeric aminic antioxidant, but containing tricresyl phosphate in place of the IDP.

In another form of the present disclosure disclosed herein, there is provided a method for improving the resistance to deposit formation of Standard Performance Category (SPC) turbine oils comprising a synthetic ester base oil, one or more monomeric aminic antioxidants and IDP antiwear additive of the formula:

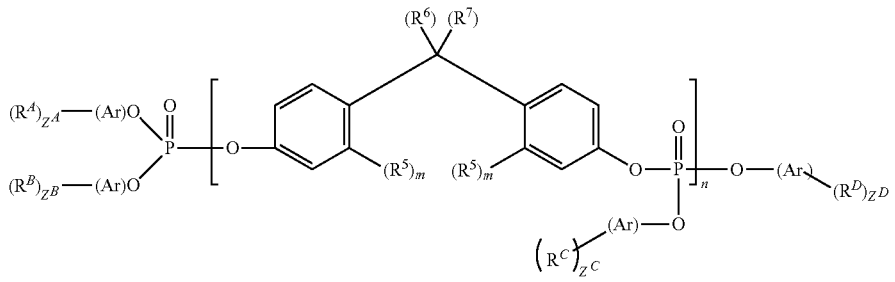

wherein $R^5$ is a $C_1$ to $C_5$ alkyl group and m is an integer ranging from zero to 4, n is an integer ranging from 1 to 7, $R^6$ is hydrogen or a $C_1$ to $C_5$ alkyl group, $R^7$ is hydrogen or a $C_1$ to $C_5$ alkyl group, each Ar is independently a phenyl or naphthyl group, $R^A$, $R^B$, $R^C$ and $R^D$ are the same or different selected from the group consisting of hydrogen, $C_1$ to $C_{18}$ alkyl groups, and when any of $R^A$ to $R^D$ are other than hydrogen the corresponding $Z^A$, $Z^B$, $Z^C$ and $Z^D$ are the same or different range from 1 to up to the available valence of each Ar group, the IDP being present in an amount in the range of 0.01 to 10 wt % based on active ingredient and contributing from 500 to 6000 ppm phosphorus, wherein the resistance to deposit formation as measured by the Vapor Phase Coker Test at 700° F. of the turbine oil is at least 40 mg lower than the deposit formation of turbine oils containing the same ester base stock and monomeric aminic antioxidant, but containing tricresyl phosphate in place of the IDP.

DETAILED DESCRIPTION

Figure 1:
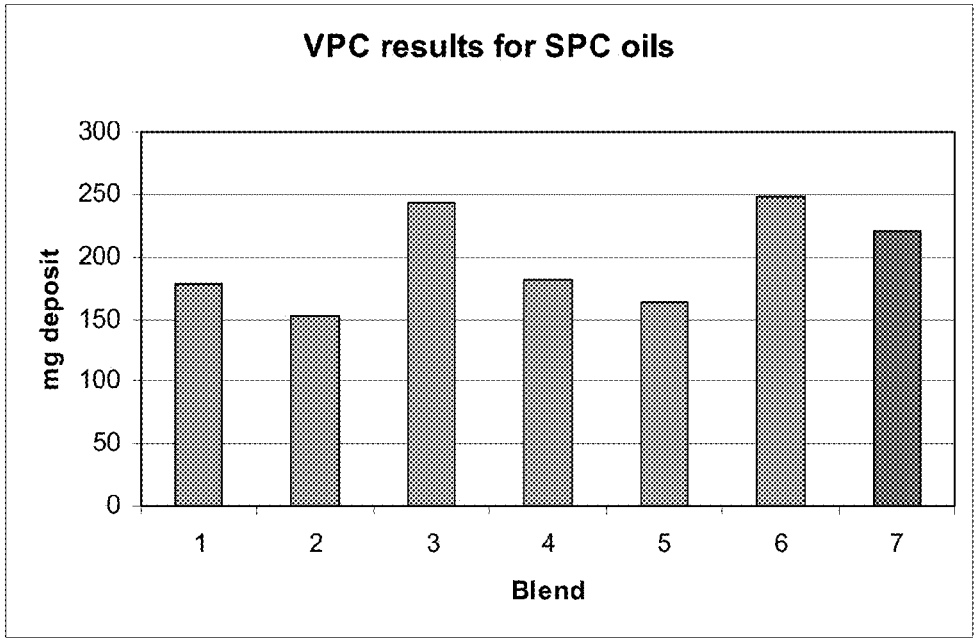
FIG. 1 compares the resistance to deposit formation of Standard Performance Category (SPC) turbine oils containing a polyol ester base stock which comprises pentaerythritol/dipentaerythritol esters of i-$C_5$, n-$C_5$, $C_7$, $C_8$ and $C_{10}$ acids, monomeric aminic antioxidants and bisphenol A diphosphate against turbine oils containing the same ester base stock and antioxidants but phosphate esters other than the bisphenol A diphosphate.
Figure 2:
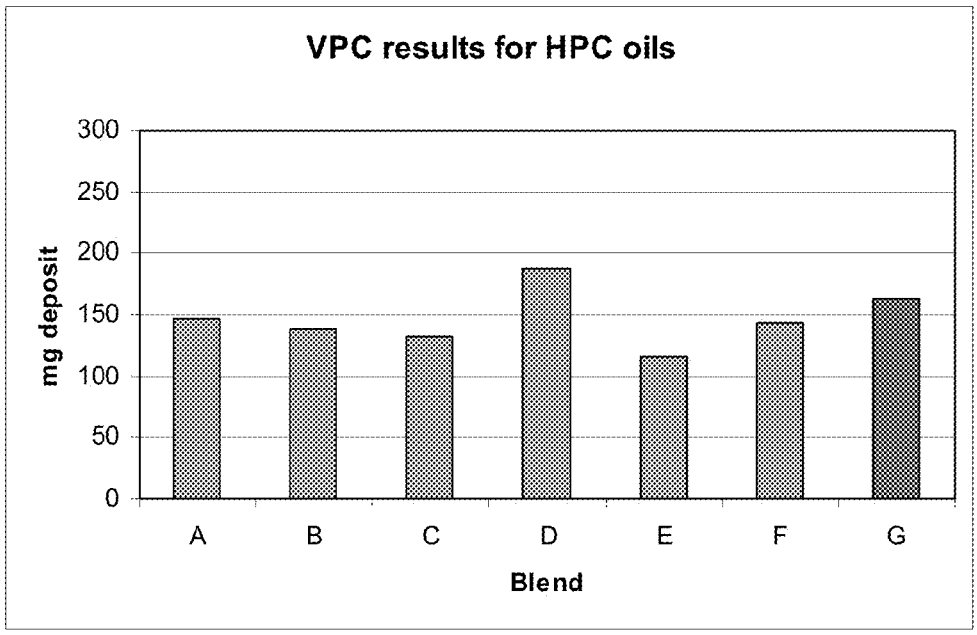
FIG. 2 compares the resistance to deposit formation of High Performance Category (HPC) turbine oils containing a polyol ester base stock which comprises pentaerythritol/dipentaerythritol esters of i-$C_5$, n-$C_5$, $C_7$, $C_8$ and $C_{10}$ acids, a polymeric amine antioxidant and bisphenol A diphosphate against turbine oils containing the same ester base stock and antioxidant but phosphate esters other than the bisphenol A diphosphate.
Figure 3:
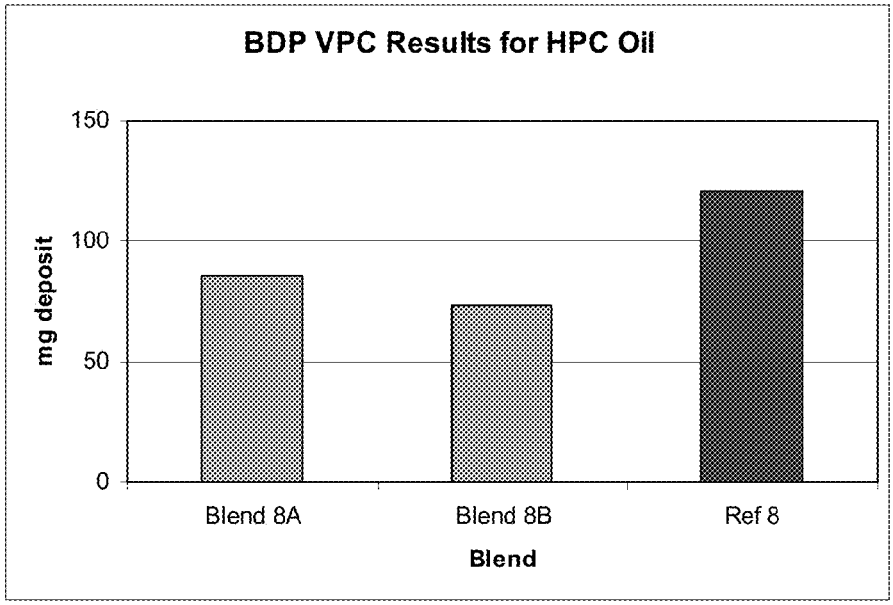
FIG. 3 compares the resistance to deposit formation of a High Performance Category (HPC) turbine oil containing a polyol ester base stock which comprises pentaerythritol/dipentaerythritol esters of n-$C_5$, n-$C_7$, $C_8$ and $C_{10}$ acids, a polymeric amine antioxidant and bisphenol A diphosphate against a turbine oil containing the same ester base stock and antioxidant but tricresyl phosphate in place of the bisphenol A diphosphate.
Figure 4:
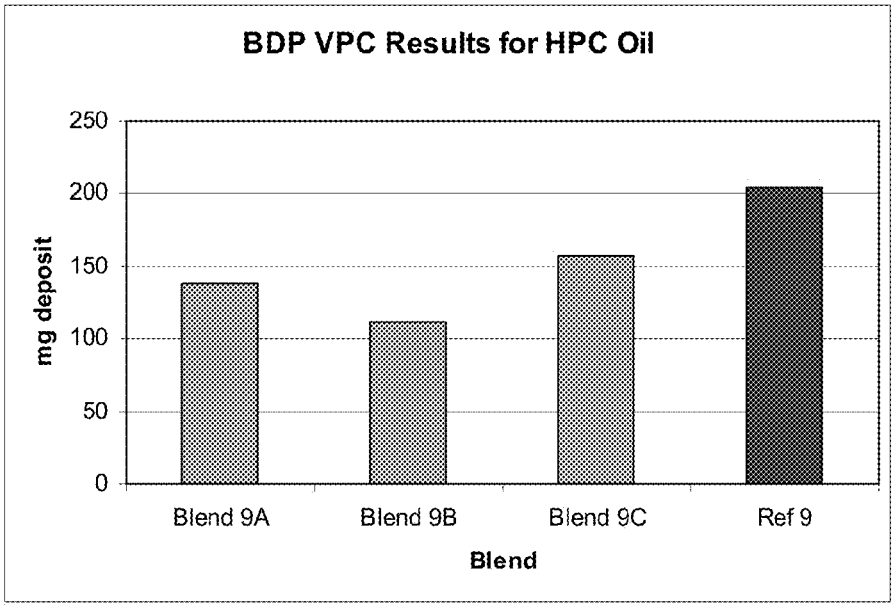
FIG. 4 compares the resistance to deposit formation of a High Performance Category (HPC) turbine oil containing a pentaerythritol/dipentaerythritol esters of i-$C_5$, n-$C_5$, $C_7$ and $C_9$ acids, a polymeric amine antioxidant and bisphenol A diphosphate against a turbine oil containing the same ester base stock and antioxidant but tricresyl phosphate in place of the bisphenol A diphosphate.
Figure 5:
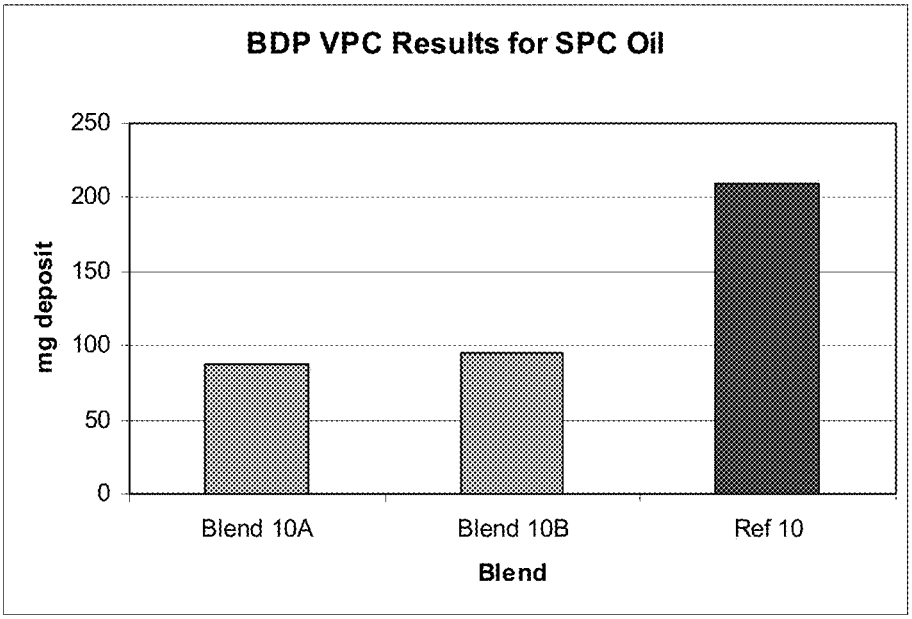
FIG. 5 compares the resistance to deposit formation of a Standard Performance Category (SPC) turbine oil containing pentaerythritol/dipentaerythritol esters of i-$C_5$, n-$C_5$, $C_7$, $C_8$ and $C_{10}$ acids (Jet Ester 1), a monomeric aminic antioxidant and bisphenol A diphosphate against a turbine oil containing the same ester base stock and antioxidant but tricresyl phosphate in place of the bisphenol A diphosphate.

All numerical values within the detailed description and the claims herein are modified by "about" or "approximately" the indicated value, and take into account experimental error and variations that would be expected by a person having ordinary skill in the art.

The present disclosure is directed to a method for improving the deposit formation resistance performance of turbine oils containing aminic antioxidant, especially High Performance Category (HPC) turbine oils, especially gas turbine oils, particularly aviation turbine oils or jet engine oils containing polymerized amine antioxidants.

Turbine oils in general are made up of a number of components which include the base oil, which is one or a mixture of synthetic esters such as polyol esters and diesters, antioxidants, antiwear agents, friction reducers, corrosion inhibitors, metal passivators and dispersants.

As the demands on the turbine oil increase in terms of load and temperature, HPC turbine oils are being formulated containing polymeric amine antioxidants to enhance oxidation stability. Most Standard Performance Category (SPC) oils contain monomeric amine antioxidants and most HPC oils contain polymeric amine antioxidants.

The present disclosure is a method for improving the deposit resistance performance of turbine oils containing aminic antioxidant additives, especially HPC turbine oil containing polymeric amine antioxidants, and phosphate-type antiwear agents by using as the antiwear agent an additive amount of a polyphosphate ester antiwear agent consisting of 4,4'-(isopropylidenediphenyl)bis(diphenyl phosphate) of the formula:

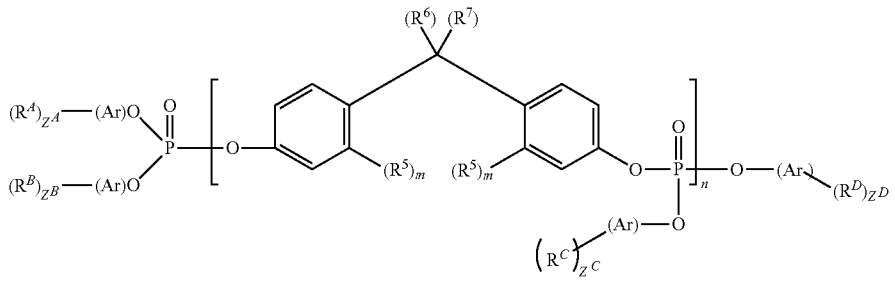

wherein $R^5$ is a $C_1$ to $C_5$ alkyl group and m is an integer ranging from zero to 4, preferably zero to 2, more preferably zero, n is an integer ranging from 1 to 7, $R^6$ is hydrogen or a $C_1$ to $C_5$ alkyl group, preferably hydrogen or a $C_1$ to $C_2$ alkyl group, more preferably hydrogen or a $C_1$ alkyl group, $R^7$ is hydrogen or a $C_1$ to $C_5$ alkyl group, preferably hydrogen or a $C_1$ to $C_2$ alkyl group, more preferably hydrogen or a $C_1$ alkyl group, each Ar is independently a phenyl or naphthyl group, $R^A$, $R^B$, $R^C$ and $R^D$ are the same or different selected from the group consisting of hydrogen, $C_1$ to $C_{18}$ alkyl groups, preferably hydrogen and $C_1$ to $C_5$ alkyl groups, and when any of $R^A$ to $R^D$ are other than hydrogen the corresponding $Z^A$, $Z^B$, $Z^C$ and $Z^D$ are the same or different, preferably the same and range from 1 to up to the available valence of each Ar group, preferably 1 to 2, most preferably 1. The 4,4'-(Isopropylidenediphenyl)bis(diphenyl phosphate) additive will be designated herein as IDP.

The IDP is used in an amount in the range 0.01 to 10 wt % (active ingredient), preferably 0.1 to 5 wt % (active ingredient), more preferably 1 to 4 wt % (active ingredient), contributing from 500 to 6000 ppm phosphorus, preferably 1000 to 4000 ppm phosphorus, to the formulation.

It has been discovered that by replacing all or a portion, preferably all, of other phosphate-type antiwear agents such as the tri-cresyl phosphate currently used in turbine oils when the antioxidant is monomeric amine antioxidant with the IDP, the deposit resistance performance of the turbine oil is enhanced as compared to the deposit resistance performance exhibited by turbine oils containing other phosphate-type antiwear additives. When the antioxidant is a polymeric amine antioxidant, then replacing the tricresyl phosphate currently used in turbine oils with the IDP improved the deposit formation resistance performance of the turbine oil.

Turbine oils, e.g. gas turbine oils, aviation turbine oils and jet engine turbine oils, employ synthetic esters and especially polyol esters as base oils.

The synthetic ester which can be used as the base oil is formed by the esterification of an aliphatic monohydric or polyhydric alcohol with linear or branched carboxylic acids.

The synthetic esters employed as base oils for the turbine oil have kinematic viscosities at 100° C. in the range of 2 to 12 $mm^2/s$, preferably 3 to 8 $mm^2/s$, more preferably 4 to 6 $mm^2/s$.

Monohydric alcohols suitable for making ester base stocks include methyl, butyl, isooctyl, didecyl and octadecyl alcohols. "Oxo" alcohols prepared by the reaction of olefins with carbon monoxide and hydrogen are suitable. Neo-alcohols, i.e., alcohols having no hydrogens on the beta carbon atom, are preferred. Examples of such alcohols are 2,2,4-trimethylpentanol and 2,2-dimethyl propanol.

The polyhydric alcohols which can be reacted with the linear acid are, by way of example, polyols represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term "carbon number" as used throughout this application refers to the total number of carbon atoms in either the acid or alcohol as the case may be) and number of hydroxyl groups contained in the polyhydroxyl compound used to form the carboxylic esters may vary over a wide range.

The following alcohols are particularly useful as polyols: 2-ethyl-1,3-hexanediol, 2-propyl-3,3-heptanediol, 2-butyl-1,3-butanediol, 2,4-dimethyl-1,3-butanediol, neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol and polyalkylene glycols (e.g., polyethylene glycols, polypropylene glycols, polybutylene glycols, etc., and blends thereof such as polymerized mixture of ethylene glycol and propylene glycol). Mixtures of such alcohols may also be used.

The carboxylic acid reactant used to produce the synthetic polyol ester base oil is selected from aliphatic monocarboxylic acids or a mixture of aliphatic monocarboxylic acids and aliphatic dicarboxylic acids. The carboxylic acids contain from 4 to 20 carbon atoms and includes the straight and branched chain aliphatic acids. The aliphatic chain may include aryl substituents. Mixtures of acids may be used.

The carboxylic acid used is a branched or linear $C_4$ to $C_{20}$ carboxylic acid.

The branched acid is preferably a mono-carboxylic acid which has a carbon number in the range between about $C_4$ to $C_{20}$, more preferably about $C_5$ to $C_{10}$ wherein methyl or ethyl branches are preferred. The mono-carboxylic acid is preferably at least one acid selected from the group consisting of: 2,2-dimethylpropionic acid (neopentanoic acid), neoheptanoic acid, neooctanoic acid, neononanoic acid, isohexanoic acid, neodecanoic acid, 2-ethylhexanoic acid (2EH), 3,5,5-trimethylhexanoic acid (TMH), isoheptanoic acid, isooctanoic acid, isononanoic acid and isodecanoic acid. One especially preferred branched acid is 3,5,5-trimethylhexanoic acid. The term "neo" as used herein refers to a trialkyl acetic acid, i.e. an acid which is triply substituted at the alpha carbon with alkyl groups. These alkyl groups are equal to or greater than $CH_3$, as shown in the general structure set forth herebelow:

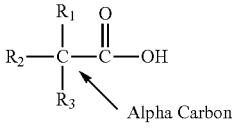

wherein $R_1$, $R_2$ and $R_3$ are greater than or equal to $CH_3$ and not equal to hydrogen.

3,5,5-trimethylhexanoic acid has the structure set forth herebelow:

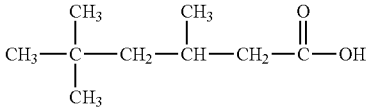

The mono-carboxylic linear acids are any linear saturated alkyl carboxylic acid having a carbon number in the range between about $C_4$ to $C_{20}$, preferably $C_5$ to $C_{10}$.

Some examples of linear acids include butyric, valeric, sebacic, azelaic, suberic, succinic, adipic, oxalic, malonic, glutaric, pentadecanedicarboxylic, diglycolic, thidiglycolic, acetic, propionic, lauric, palmitic, pimilic, n-hexanoic, n-heptanoic, n-octanoic, n-nonanoic, and n-decanoic acids and mixtures thereof.

Examples of suitable ester base oils are ethyl palmitate, ethyl laurate, butyl stearate, di-(2-ethylhexyl) sebacate, di(2-ethylhexyl) azealate, ethyl glycol dilaurate, di-(2-ethylhexyl) phthalate, di-(1,3-methylbutyl) adipate, di-(1-ethylpropyl) azelate, diisopropyloxylate, dicyclohexyl sebacate, glycerol tri-n-heptoate, di(undecyl) azelate, and tetraethylene glycol di-(2-ethyl caproate), and mixtures thereof.

If it is desired to form a complex alcohol ester or complex acid ester, then the synthetic ester can also include a polybasic acid selected from the group consisting of: any $C_2$ to $C_{12}$ polybasic acids, e.g. adipic, azelaic, sebacic and dodecanedioic acids.

Other preferred polyol ester base oils are those ones prepared from technical pentaerythritol and a mixture of linear and branched $C_4$ to $C_{20}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the formula:

I

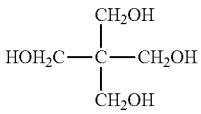

and about 12% of dipentaerythritol having the formula:

II

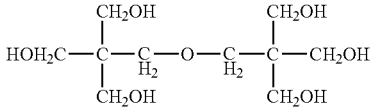

The technical pentaerythritol may also contain some tri- and tetrapentaerythritol that is normally formed as by-products during the manufacture of technical pentaerythritol.

The preparation of esters from alcohols and carboxylic acids can be accomplished using conventional methods and techniques known and familiar to those skilled in the art. In general, the monohydric alcohol or polyhydric alcohol, e.g. technical pentaerythritol, is heated with the desired carboxylic acid or mixture of acids either neat or in the presence of a solvent such as an aromatic hydrocarbon and optionally in the presence of catalyst such as, e.g. titanium, zirconium and tin catalysts such as titanium, zirconium or tin alcohalates, carboxylates and chelates, HCl, HF, HBr, $H_2SO_4$, $BF_3$, etc., see for example U.S. Pat. No. 3,038,859 and U.S. Pat. No. 3,121,109.

Generally, a slight excess of acid is employed to force the reaction to completion to produce a fully esterified product. Water is removed during the reaction and any excess acid is then stripped from the reaction mixture. The esters of technical pentaerythritol may be used without further purification or may be further purified using conventional techniques such as distillation or other methods known to those of skill in the art.

Other polyol esters useful as turbine oil base oils are those made by synthesizing the polyol esters from a polyol and a branched or linear carboxylic acid in such a way that it has a substantial amount of unreacted hydroxyl groups, that is the product is not fully esterified. The presence of the unreacted hydroxyl group in the ester is believed to allow this "high" hydroxyl ester to exhibit increased thermal/oxidation stability, as measured by high pressure differential scanning calorimetry (HPDSC). It is believed the presence of the unreacted hydroxyl group provides a pathway capable of scavenging alkoxide and alkyl peroxide radicals formed in the turbine oil during use, such scavenging thereby reducing the rate at which oxidation degradation can occur.

The high hydroxyl polyester is the reaction product of a linear or branched alcohol and at least one branched and/or linear carboxylic acid, the resulting synthetic ester having a hydroxyl number between 5 to 180 depending on the acid and polyol used (e.g. 1 to 25% unconverted hydroxyl groups, based on the total amount of hydroxyl groups in the branched or linear alcohol), preferably between about 5 to 100 (e.g. 1 to 15% unconverted hydroxyl groups), more preferably between 10 to 80 (e.g. 2 to 10% unconverted hydroxyl groups).

Hydroxyl number measures the free hydroxyl groups by determining the amount of acetic anhydride that the sample will react with under certain conditions. Anhydride is introduced in excess with the sample. Once the reaction is complete, the remaining anhydride is determined by titration with a base solution. The hydroxyl number is reported as milligrams of KOH/gram of sample. A standard method for measuring hydroxyl number is detailed by the American Oil Chemist's Society as A.O.C.S. Cd. 13-60. For highly converted esters, e.g. 99% or more conversion to ester (almost no unreacted hydroxyl groups), the hydroxyl number is generally less than or equal to 5.

In the case of both the fully esterified ester and the ester containing free hydroxyl groups, the alcohols and acids employed can be the same, the only difference in the products being, as previously indicated, that in one instance the product is fully esterified and in the other the product has free hydroxyl groups.

Mixtures of fully esterified synthetic esters and of synthetic esters containing free hydroxyl groups can also be used.

Esters suitable for use as base stocks for turbine oils are esters of monocarboxylic acids having three to twelve carbons and polyalcohols such as pentaerythritol, dipentaerythritol and trimethylolpropane. Examples of these esters are pentaerythrityl tetrabutyrate, pentaerythrityl tetravalerate, pentaerythrityl tetracaproate, pentaerythrityl dibutyratedicaproate, pentaerythrityl butyratecaproate divalerate, pentaerythrityl butyrate trivalerate, pentaerythrityl butyrate tricaproate, pentaerythrityl tributyratecaproate, mixed $C_4$- to $C_{10}$-saturated fatty acid esters of pentaerythritol, dipentaerythrityl hexavalerate, dipentaerythrityl hexacaproate, dipentaerythrityl hexaheptoate, dipentaerythrityl hexacaprylate, dipentaerythrityl tributyrate tricaproate, dipentaerythrityl trivalerate trinonylate, dipentaerythrityl mixed hexaesters of $C_4$ to $C_{10}$ fatty acids and trimethylolpropane heptylate. Pentaerythrityl esters of mixtures of $C_4$ to $C_{12}$ acids are excellent base oils and are commercially available from Hercules Chemical Company.

If desired the synthetic esters, e.g. fully esterified and/or esters containing free hydroxyl groups, can be further used with other base stocks such as mineral oil, highly refined mineral oil, polyalpha olefins, polyalkylene glycols, phosphate esters, silicone oils, other polyol esters, as well as hydrocarbon oils made by hydrodewaxing/hydroisomerizing waxy feeds such as hydrodewaxed/hydroisomerized slack wax or Fischer-Tropsch synthesis waxes.

It is preferred, however, that the synthetic ester be it a fully esterified material or an ester containing free hydroxyl groups either be used individually or only in the mixture of two or more esters.

Aromatic amine antioxidants are well known and are one or more hydrocarbyl-substituted or unsubstituted diphenyl amines, one or more hydrocarbyl-substituted or unsubstituted phenyl naphthyl amines, one or more hydrocarbyl-substituted or unsubstituted phenothiazines and mixtures thereof wherein the hydrocarbyl-substituent is styrene or $C_1$ to $C_{30}$ alkyl, preferably $C_1$ to $C_{30}$ alkyl, more preferably $C_4$ to $C_{10}$ alkyl. Other monomeric aryl amines have been described in the patent literature.

Polymeric amine antioxidants are the polymerization reaction products of one or more unsubstituted or hydrocarbyl-substituted diphenyl amines, one or more unsubstituted or hydrocarbyl-substituted phenyl naphthyl amines or both one or more of unsubstituted or hydrocarbyl-substituted diphenylamine with one or more unsubstituted or hydrocarbyl-substituted phenyl naphthylamine A representative schematic is presented below:

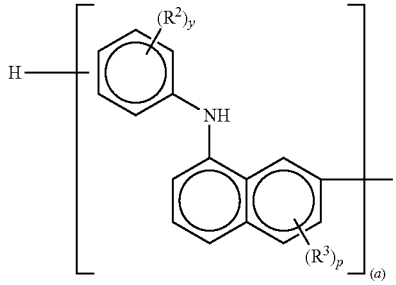

and

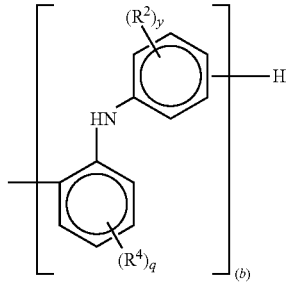

wherein (a) and (b) each range from zero to 10, preferably zero to 5, more preferably zero to 3, most preferably 1 to 3, provided (a)+(b) is at least 2; for example:

(A)

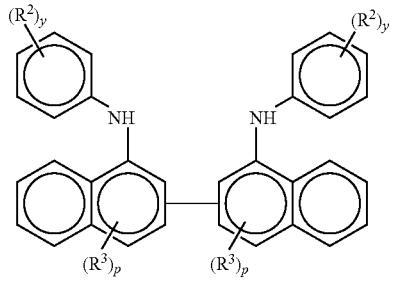

or (B)

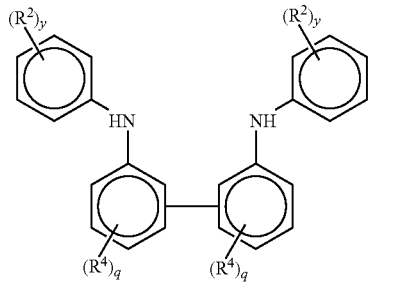

or

-continued (C)

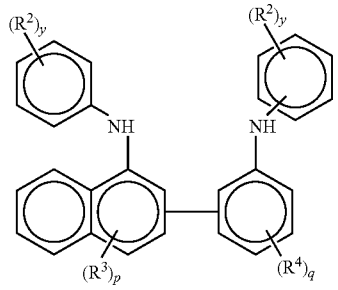

or (D)

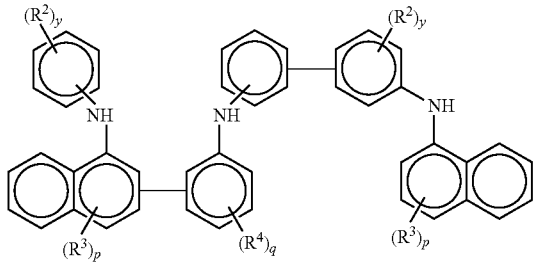

wherein $R^2$ is a styrene or $C_1$ to $C_{30}$ alkyl, $R^3$ is a styrene or $C_1$ to $C_{30}$ alkyl, $R^4$ is a styrene or $C_1$ to $C_{30}$ alkyl, preferably $R^2$ is a $C_1$ to $C_{30}$ alkyl, $R^3$ is a $C_1$ to $C_{30}$ alkyl, $R^4$ is a $C_1$ to $C_{30}$ alkyl, more preferably $R^2$ is a $C_4$ to $C_{10}$ alkyl, $R^3$ is a $C_4$ to $C_{10}$ alkyl and $R^4$ is a $C_4$ to $C_{10}$ alkyl, p, q and y individually range from 0 to up to the valence of the aryl group to which the respective R groups are attached, preferably at least one of p, q and y range from 1 to up to the valence of the aryl group to which the respective R group(s) are attached, more preferably p, q and y each individually range from at least 1 to up to the valence of the aryl group to which the respective R groups are attached.

Other more extensive oligomers are within the scope of this disclosure, but materials of formulae A, B, C and D are preferred.

The polymeric amine antioxidant may contain nonpolymerized aryl amine antioxidant starting materials as a result of the preparation procedure. When polymeric aryl amine antioxidants are employed so as to produce High Performance Category (HPC) turbine oils, additional monomeric amine antioxidants may be added to the lubricant to impart desired properties. Examples of monomeric amine antioxidants include but are not limited to diphenyl amine, alkylated diphenyl amines, styrenated diphenyl amines, phenyl-N-naphthyl amine, alkylated phenyl-N-naphthyl amines, styrenated phenyl-N-naphthyl amines, phenothiazine, alkylated phenothiazine and styrenated phenothiazine. Other antioxidants such as hindered phenols and zinc dithiophosphates can also be added to the lubricant in addition to the polymerized amine antioxidant.

The aromatic amine, preferably polymeric amine, antioxidant is present in an amount in the range 0.5 to 10 wt % (active ingredient), preferably 2 to 5 wt % (active ingredient) of aminic antioxidant. When polymeric aminic antioxidant is employed, the amounts recited above are exclusive of any unpolymerized aryl amine which may be present or of any added antioxidants.

The deposit resistance performance of a turbine oil containing polyol ester base stock and aromatic amine antioxidant, preferably polymeric amine antioxidant, is improved by the use of IDP antiwear additive of the formula:

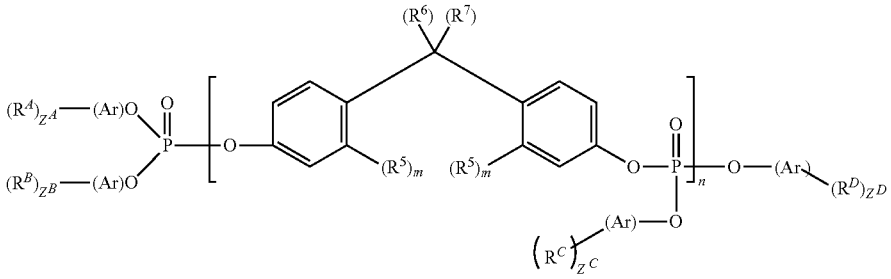

wherein $R^5$ is a $C_1$ to $C_5$ alkyl group and m is an integer ranging from zero to 4, preferably zero to 2, more preferably zero, n is an integer ranging from 1 to 7, $R^6$ is hydrogen or a $C_1$ to $C_5$ alkyl group, preferably hydrogen or a $C_1$ to $C_2$ alkyl group, more preferably hydrogen or a $C_1$ alkyl group, $R^7$ is hydrogen or a $C_1$ to $C_5$ alkyl group, preferably hydrogen or a $C_1$ to $C_2$ alkyl group, more preferably hydrogen or a $C_1$ alkyl group, each Ar is independently a phenyl or naphthyl group, $R^A$, $R^B$, $R^C$ and $R^D$ are the same or different selected from the group consisting of hydrogen, $C_1$ to $C_{18}$ alkyl groups, preferably hydrogen and $C_1$ to $C_5$ alkyl groups, and when any of $R^A$ to $R^D$ are other than hydrogen the corresponding $Z^A$, $Z^B$, $Z^C$ and $Z^D$ are the same or different, preferably the same and range from 1 to up to the available valence of each Ar group, preferably 1 to 2, most preferably 1.

The IDP antiwear additive is used in an amount in the range 0.01 to 10 wt % (active ingredient), preferably 0.1 to 5 wt % (active ingredient), more preferably 1 to 4 wt % (active ingredient), contributing from 500 to 6000 ppm phosphorus, preferably 1000 to 4000 ppm phosphorus to the formulation.

The turbine oils benefitted by the present method include turbine oils further containing additive amounts of any of the additives common to turbine oil formulations including by way of example and not limitation corrosion inhibitors such as combinations of one or more dicarboxylic acids and a linear or branched alkyl or alkenyl succinic acid/anhydride ester or hemiester or hydroxylated derivative of such esters or hemiesters or linear or branched alkyl or alkenyl-substituted succinimides or amino-substituted succinimides, as well as additional other antioxidants including phenolic and monomeric aminic antioxidants, extreme pressure additives, antifoamants, detergents, hydrolytic stabilizers, metal deactivators, rust inhibitors, colorants, odorants, deodorants, viscosity modifiers, viscosity index improvers, etc. as desired by the practitioner.

It has been discovered that by replacing all or a portion, preferably all, of other phosphate-type antiwear agents such as the tri-cresyl phosphate currently used in turbine oils with IDP, when the antioxidant is one or more of a polymeric aminic antioxidant, the deposit formation resistance performance of such oil is superior to that of turbine oils containing the same ester base stock and polymeric aminic antioxidant but containing tricresyl phosphate in place of the IDP. In the Vapor Phase Coker Test at 700° F., the deposit formation resistance performance of HPC turbine oils containing IDP may be 30 mg lower, or 40 mg lower, or 50 mg lower, or 60 mg lower, or 70 mg lower, that is better, than the performance of turbine oils containing the same ester base stock and polymeric aminic antioxidant but containing tricresyl phosphate in place of the IDP.

It has also been discovered that the deposit formation resistance performance of turbine oils containing monomeric aminic antioxidants can also be improved by employing IDP, the deposit formation resistance performance being improved compared to the deposit formation performance exhibited by turbine oils containing the same base stock and monomeric aminic antioxidants but containing tricresyl phosphate in place of the IDP. The improvement may be seen as a reduction in the deposits formed by at least 40 mg, or at least 60 mg, or at least 80 mg, or at least 100 mg, or at least 130 mg, compared to turbine oils containing the same ester base stock and monomeric aminic antioxidants, but tricresyl phosphate in place of the IDP.

The following are examples of the present disclosure and are not to be construed as limiting.

EXAMPLES

The different phosphate esters evaluated in the following Examples are presented below in Table 1:

TABLE 1

| | |
|---|---|
| RDP<br>n = 1 to 7 | 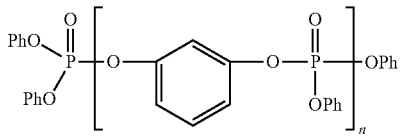 |
| IDP<br>n = 1 to 7 | 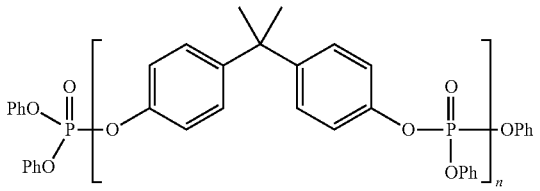 |
| t-Bu-TPP<br>with varying amount of unbutylated triphenyl phosphate (TPP) | 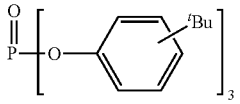 |
| Tricresyl Phosphate (TCP) | 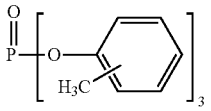 |
| Trixylyl Phosphate (TXP) | 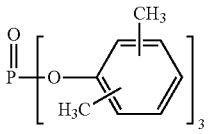 |

The polyol ester oils used as base stocks in the formulations evaluated in the following Example are presented and identified below in Table 2:

Table 2

Jet Ester 1:
PE/di-PE ester of i-$C_5$, n-$C_5$, $C_7$, $C_8$ and $C_{10}$ acids
Jet Ester 2:
PE/di-PE ester of i-$C_5$, n-$C_5$, $C_7$ and $C_9$ acids
Jet Ester 3:
PE/di-PE ester of n-$C_5$, n-$C_7$, $C_8$ and $C_{10}$ acids wherein PE/di-PE means technical pentaerythritol which is a mixture of mono-pentaerythritol and di-pentaerythritol.

Two different polymeric amine antioxidants were employed in the Examples presented. The specific polymeric amine antioxidant used is identified in each Example.

The two polymeric amine antioxidants were prepared according to the teachings of U.S. Pat. No. 3,573,206. Polymeric Antioxidant 1 and polymeric Antioxidant 2 were prepared by combining $C_8$-alkylated phenyl-α-naphthylamine and dioctyldiphenyl amine in a 3-to-2 ratio oligomerized to different degrees through the use of various amounts of alkyl peroxide. The treat rates of the antioxidants were adjusted based on the variations in percent active ingredient of the antioxidants to achieve an active ingredient treat level in each formulation of 2.8 wt % (active ingredient).

The definitions and criteria for certification of commercial jet oils as SPC or HPC are given in the SAE specification AS5780. This specification defines basic physical, chemical and performance limits for 5 cSt grades of gas turbine engine lubricating oils used in aero- and aero-derived marine and industrial applications, along with standard test methods and requirements for laboratories performing them. It also defines the quality control requirements to assure batch conformance and materials traceability, and the procedures to manage and communicate changes in oil formulation and brand.

The compositional profiles of the turbine (jet) engine oils are provided in Table 3, Table 4 and Table 5:

TABLE 3

Standard Performance Category (SPC) Turbine (Jet) Oils

| Component, wt % | Blend 1 | Blend 2 | Blend 3 | Blend 4 | Blend 5 | Blend 6 | Blend 7 |
|---|---|---|---|---|---|---|---|
| Jet Ester 1 | 95.515 | 95.225 | 94.675 | 94.585 | 94.865 | 95.015 | 94.845 |
| Monomeric Amine Antioxidants | 2 | 2 | 2 | 2 | 2 | 2 | 2 |
| Metal passivators | 0.145 | 0.145 | 0.145 | 0.145 | 0.145 | 0.145 | 0.145 |
| Defoamant | 0.01 | 0.01 | 0.01 | 0.01 | 0.01 | 0.01 | 0.01 |
| A: RDP | 2.33 | — | — | — | — | — | — |
| B. IDP | — | 2.62 | — | — | — | — | — |
| C. Butylated triphenyl phosphate of which 11.8% is TPP | — | — | 3.17 | — | — | — | — |
| D. Butylated triphenyl phosphate of which 6.6% is TPP | — | — | — | 3.26 | — | — | — |
| E. Butylated triphenyl phosphate of which 4.2% is TPP | — | — | — | — | 2.98 | — | — |
| F. 82% TCP/18% TXP | — | — | — | — | — | 2.83 | — |
| G. Durad 125 (TCP) | — | — | — | — | — | — | 3 |
| Phosphorus (ppm) | 2590 | 2310 | 2370 | 2350 | 2410 | 2470 | 2430 |
| VPC at 700 F., mg deposits | 178.6 | 152.4 | 244 | 182.1 | 163.5 | 248.8 | 219.8 |

TABLE 4

High Performance Category (HPC) Turbine (Jet) Oils

| Component, wt % | Blend A | Blend B | Blend C | Blend D | Blend E | Blend F | Blend G |
|---|---|---|---|---|---|---|---|
| Jet Ester 1 | 91.13 | 90.84 | 90.39 | 90.32 | 90.55 | 90.67 | 90.53 |
| Polymeric Antioxidant 1 | 7 | 7 | 7 | 7 | 7 | 7 | 7 |
| Metal Passivator | 0.06 | 0.06 | 0.06 | 0.06 | 0.06 | 0.06 | 0.06 |
| Defoamant | 0.01 | 0.01 | 0.01 | 0.01 | 0.01 | 0.01 | 0.01 |
| A: RDP | 1.87 | — | — | — | — | — | — |
| B. IDP | — | 2.09 | — | — | — | — | — |
| C. Butylated triphenyl phosphate of which 11.8% is TPP | — | — | 2.54 | — | — | — | — |
| D. Butylated triphenyl phosphate of which 6.6% is TPP | — | — | — | 2.61 | — | — | — |
| E. Butylated triphenyl phosphate of which 4.2% is TPP | — | — | — | — | 2.38 | — | — |
| F. 82% TCP/18% TXP | — | — | — | — | — | 2.26 | — |
| G. Durad 125 (TCP) | — | — | — | — | — | — | 2.4 |
| Phosphorus (ppm) | 1870 | 1870 | 1910 | 1790 | 1810 | 1830 | 1990 |
| VPC at 700 F., mg deposits | 146.7 | 138.2 | 131.9 | 186.7 | 115.1 | 143.6 | 163.5 |

TABLE 5

| Component, wt % | Blend 2 | Blend 7 | Blend 8A | Blend 8B | Ref. 8 | Blend 9A | Blend 9B | Blend 9C | Ref 9 | Blend 10A | Blend 10B | Ref 10 |
|---|---|---|---|---|---|---|---|---|---|---|---|---|
| Jet Ester 1 | 90.84 | 90.53 | | | | | | | | 95.88 | 94.65 | 94.84 |
| Jet Ester 2 | | | | | | 87.98 | 87.32 | 86.67 | 86.94 | | | |
| Jet Ester 3 | | | 91.36 | 90.32 | 90.53 | | | | | | | |
| Monomeric Aminic Antioxidant | | | | | | | | | | 2 | 2 | 2 |
| Polymeric Antioxidant 1 | 7 | 7 | 7 | 7 | 7 | | | | | | | |
| Polymeric | | | | | | 10 | 10 | 10 | 10 | | | |

TABLE 5-continued

| Component, wt % | Blend 2 | Blend 7 | Blend 8A | Blend 8B | Ref. 8 | Blend 9A | Blend 9B | Blend 9C | Ref 9 | Blend 10A | Blend 10B | Ref 10 |
|---|---|---|---|---|---|---|---|---|---|---|---|---|
| Antioxidant 2 | | | | | | | | | | | | |
| Metal Passivator | 0.06 | 0.06 | 0.06 | 0.06 | 0.06 | 0.05 | 0.05 | 0.05 | 0.05 | 0.15 | 0.15 | 0.15 |
| Defoamant | 0.01 | 0.01 | 0.01 | 0.01 | 0.01 | 0.01 | 0.01 | 0.01 | 0.01 | 0.01 | 0.01 | 0.01 |
| IDP | 2.09 | | 1.57 | 2.61 | | 1.97 | 2.62 | 3.28 | | 1.97 | 3.28 | |
| Durad 125 TCP | | 2.4 | | | 2.4 | | | | | | | |
| Durad 120XC (TCP/TXP) | | | | | | | | | 3 | | | 3 |
| Phosphorus (ppm) | 2310 | 2430 | 1410 | 2340 | 2010 | 1780 | 2369 | 2930 | 2530 | 1750 | 2940 | 2570 |
| VPC at 700 F., mg deposits | 152.4 | 219.8 | 85.4 | 73.8 | 121.2 | 138.4 | 111.9 | 157.9 | 203.9 | 87.5 | 95.2 | 209.7 |

It is seen that the amounts IDP added to the different blends in Table 5 varied from blend to blend. The amount of IDP added to Blend 2 was an amount sufficient to provide an amount of phosphorus equal to 100% of the amount of phosphorus contributed to Blend 7 by the Durad 125 (TCP). Blend 8A contains sufficient IDP to equal 75% of the amount of phosphorus contained in Ref. 8 contributed by the Durad 125 (TCP) while Blend 8B contains sufficient IDP to equal 125% of the amount of phosphorus contained in Ref. 8. Blends 9A, 9B and 9C contain amounts of IDP sufficient to equal 75%, 100% and 125%, respectively, of the amount of phosphorus contained in Ref. 9 contributed by the Durad 120XC (TCP/TXP). Blends 10A and 10B contain amounts of IDP sufficient to equal 75% and 125%, respectively, of the amount of phosphorus contained in Ref. 10 contributed by Durad 120XC (TCP/TXP).

The VPC test results were obtained using the Vapor Phase Coker (VPC) test at 700° F. The VPC Test is described in Aerospace Recommended Practice (ARP) 5921 Vapor Phase Coking. This ARP, still in draft form, is available from Mr. James McDonnell, Fuel & Lubricants Division, Naval Air Systems Command, 22229 Elmer Road, Patuxent River, Md. 20670, U.S.A.

Table 3 shows that formulations containing the IDP exhibited superior deposit formation resistance performance compared to any of the other formulations containing any of the other phosphate-type antiwear additives when employed in combination with monomeric aminic antioxidants.

Table 4 shows that the formulations containing the IDP exhibited superior deposit formation resistance performance compared to those formulations containing RDP, tricresyl phosphate and butylated triphenyl phosphate (of which a small portion is unsubstituted triphenyl phosphate) when employed in combination with polymeric aminic antioxidant to produce a HPC turbine oil.

Blends 8A and 8B in Table 5 compare the resistance to deposit formation of a HPC turbine oil containing a mixture of pentaerythritol/dipentaerythritol esters of n-$C_5$, n-$C_7$, $C_8$ and $C_{10}$ acids (Jet Ester 3), a polymeric aminic antioxidant and IDP against a turbine oil containing the same ester base stock and antioxidant but tricresyl phosphate in place of the IDP (Blend 8).

Blends 9A, 9B, and 9C in Table 5 compare the resistance to deposit formation of a HPC turbine oil containing pentaerythritol/dipentaerythritol esters of i-$C_5$, n-$C_5$, $C_7$ and $C_9$ acids (Jet Ester 2), a polymeric aminic antioxidant and IDP against a turbine oil containing the same ester base stock and antioxidant but tricresyl phosphate in place of the IDP (Blend 9)

Blends 10A and 10 B in Table 5 compare the resistance to deposit formation of an SPC turbine oil containing pentaerythritol/dipentaerythritol esters of i-$C_5$, n-$C_5$, $C_7$, $C_8$ and $C_{10}$ acids (Jet Ester 1), a mixture of monomeric aminic antioxidants, and IDP against a turbine oil containing the same ester base stock and antioxidant but tricresyl phosphate in place of the IDP (Blend 10)

All formulation groups containing the IDP exhibited deposit formation resistance performance superior to that of the formulations containing tricresyl phosphate. Those formulations (Blends 8 and 9) using either Jet Ester 2 or Jet Ester 3 exhibited deposit formation performance at least 35 mg lower, preferably about 45 mg lower, more preferably about 60 mg lower, still more preferably about 90 mg lower than the deposit formation performance exhibited by the reference oils employing tricresyl phosphate and containing the polymeric aminic antioxidants. Formulations 10A and 10B using Jet Ester 1 and a monomeric aminic antioxidant exhibited deposit formation performance of about 115 mg to about 120 mg lower than the deposit formation performance exhibited by Ref. 10 containing the same ester base stock and monomeric amine antioxidant but tricresyl phosphate in place of the IDP.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

All patents, test procedures, and other documents cited herein, including priority documents, are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated.

What is claimed is:

1. A method for improving the resistance to deposit formation of High Performance Category turbine oil comprising a synthetic polyol ester base oil, one or more of a polymeric aryl aminic antioxidant and IDP antiwear additive of the formula:

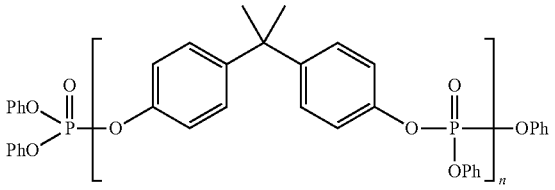

wherein n=1 to 7, Ph is phenyl, the IDP being present in an amount in the range of 2.09 to 3.28 wt % based on active ingredient, wherein the resistance to deposit formation as measured by the Vapor Phase Coker Test at 700° F. of the turbine oil is at least 30 mg lower than the deposit formation of turbine oils containing the same ester base stock and polymeric aryl aminic antioxidant, but containing tricresyl phosphate in place of the IDP, and wherein the one or more polymeric aryl aminic antioxidant are present in an amount in the range 7 to 10 wt % as delivered.

2. The method of claim 1 wherein the one or more polymeric aryl aminic antioxidant is the polymerized reaction product of one or more diphenyl amines, one or more phenyl naphthyl amines or both one or more diphenyl amines with one or more phenyl naphthyl amines.

3. The method of claim 1 wherein the one or more polymeric aryl aminic antioxidants is the reaction product of:

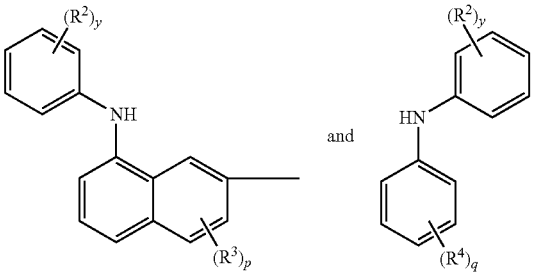

wherein $R^2$ is styrene or a $C_1$ to $C_{30}$ alkyl, $R^3$ is styrene or a $C_1$ to $C_{30}$ alkyl, $R^4$ is styrene or a $C_1$ to $C_{30}$ alkyl, p, q and y individually range from zero to up to the valence of the aryl group to which the respective R groups are attached.

4. The method of claim 1, 2, or 3, wherein the synthetic polyol ester consists of monopentaerythritol/dipentaerythritol esters of i-$C_5$ acid, n-$C_5$ acid, $C_7$ acid and $C_9$ acid, or a mixture of monopentaerythritol/dipentaerythritol esters of n-$C_5$ acid, n-$C_7$ acid, $C_8$ acid and $C_{10}$ acid.

5. A method for improving the resistance to deposit formation of Standard Performance Category (SPC) turbine oils comprising a synthetic polyol ester base oil, one or more monomeric aminic antioxidants and IDP antiwear additive of the formula:

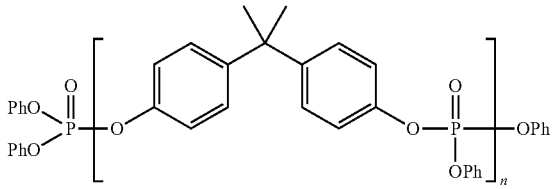

wherein n=1 to 7, Ph is phenyl, the IDP being present in an amount in the range of 2.09 to 3.28 wt % based on active ingredient, wherein the resistance to deposit formation as measured by the Vapor Phase Coker Test at 700° F. of the turbine oil is at least 40 mg lower than the deposit formation of turbine oils containing the same ester base stock and monomeric aminic antioxidant, but containing tricresyl phosphate in place of the IDP, and wherein the one or more monomeric aminic antioxidant are present in an amount in the range 2 to 5 wt % based on active ingredient.

* * * * *